US009416703B2

(12) United States Patent
Nagel et al.

(10) Patent No.: US 9,416,703 B2
(45) Date of Patent: Aug. 16, 2016

(54) MIXER CONFIGURATION FOR REDUCING AGENT PREPARATION AND MOTOR VEHICLE HAVING A MIXER CONFIGURATION

(71) Applicant: EMITEC GESELLSCHAFT FUER EMISSIONSTECHNOLOGIE MBH, Lohmar (DE)

(72) Inventors: Thomas Nagel, Engelskirchen (DE); Peter Alberti, Wasbuettel (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 14/262,961

(22) Filed: Apr. 28, 2014

(65) Prior Publication Data

US 2014/0230419 A1 Aug. 21, 2014

Related U.S. Application Data

(63) Continuation of application No. PCT/EP2012/070478, filed on Oct. 16, 2012.

(30) Foreign Application Priority Data

Oct. 28, 2011 (DE) ..... 10 2011 117 139

(51) Int. Cl.

| | |
|---|---|
| ***F01N 3/24*** | (2006.01) |
| ***F01N 3/02*** | (2006.01) |
| ***B01F 5/06*** | (2006.01) |
| ***B01F 3/04*** | (2006.01) |

(52) U.S. Cl.

CPC ..... *F01N 3/02* (2013.01); *B01F 3/04021* (2013.01); *B01F 5/0618* (2013.01)

(58) Field of Classification Search

CPC .. B01F 3/04021; B01F 5/0268; B01F 5/0473; B01F 5/0618; B01F 2005/0625; B01F 2005/0638; F01N 3/2892; F01N 2240/20; F01N 2610/1453

See application file for complete search history.

(56) References Cited

U.S. PATENT DOCUMENTS

| | | | |
|---|---|---|---|
| 6,074,619 | A | 6/2000 | Schoubye |
| 6,969,492 | B1 | 11/2005 | Goerigk et al. |

(Continued)

FOREIGN PATENT DOCUMENTS

| | | | |
|---|---|---|---|
| DE | 102011112988 | A1 | 4/2012 |
| EP | 0864732 | A1 | 9/1998 |

(Continued)

*Primary Examiner* — Audrey K Bradley
*Assistant Examiner* — Jonathan Matthias
(74) *Attorney, Agent, or Firm* — Laurence A. Greenberg; Werner H. Stemer; Ralph E. Locher

(57) ABSTRACT

A mixer configuration for mixing an additive with an exhaust gas stream includes at least one overflow surface which is disposed in a mixing section of an exhaust pipe. The exhaust pipe has a cross section and a main flow direction of the exhaust gas stream. The at least one overflow surface is disposed centrally in the mixing section, is directed along the main flow direction of the exhaust gas stream and has a multiplicity of closed depressions. The mixer configuration permits an excellent mixture of the exhaust gas stream with an additive, without generating a high flow resistance in the process. A motor vehicle having a mixer configuration is also provided.

13 Claims, 3 Drawing Sheets

(56) References Cited

U.S. PATENT DOCUMENTS

| | | | | |
|---|---|---|---|---|
| 8,082,732 | B2 | 12/2011 | Nefischer | |
| 2008/0134671 | A1* | 6/2008 | Nefischer | 60/300 |
| 2009/0071133 | A1 | 3/2009 | Mabuchi | |
| 2009/0114369 | A1* | 5/2009 | Kammerzell | F24F 12/006 165/47 |
| 2012/0042655 | A1* | 2/2012 | Lam | 60/737 |

FOREIGN PATENT DOCUMENTS

| | | | |
|---|---|---|---|
| EP | 1054139 | A1 | 11/2000 |
| EP | 1936137 | A1 | 6/2008 |

* cited by examiner

MIXER CONFIGURATION FOR REDUCING AGENT PREPARATION AND MOTOR VEHICLE HAVING A MIXER CONFIGURATION

CROSS-REFERENCE TO RELATED APPLICATION

This is a continuation, under 35 U.S.C. §120, of International Application No. PCT/EP2012/070478, filed Oct. 16, 2012, which designated the United States; this application also claims the priority, under 35 U.S.C. §119, of German Patent Application DE 10 2011 117 139.1, filed Oct. 28, 2011; the prior applications are herewith incorporated by reference in their entirety.

BACKGROUND OF THE INVENTION

Field of the Invention

The invention relates to a mixer configuration for mixing exhaust gas in an exhaust pipe with an additive, in which the additive is, in particular, added to the exhaust gas and is uniformly distributed therein. The invention also relates to a motor vehicle having a mixer configuration.

In internal combustion engines, in particular diesel engines and lean-mix engines, an undesirably high quantity of nitrogen oxides occurs. An appropriate way of eliminating the latter is, in particular, the addition of the additive ammonia, as a result of which, even in the event of excess oxygen, the nitrogen oxides can be reduced to nitrogen and the hydrogen portion of the ammonia combines with water. For mobile use, the storage of the irritant gas ammonia has proven unsuitable. By contrast, the storage of ammonia in the form of urea dissolved in water has proven successful for mobile use. For that purpose, the use of a solution containing 32.5% of urea and referred to as AdBlue® has become generally accepted on the market. However, the urea-water solution has to be correspondingly prepared by hydrolysis and/or thermolysis. The term additive is therefore used below, in particular, as a synonym for a (liquid or at least partially gaseous) reducing agent and/or a reducing agent precursor for carrying out the so-called SCR process (selective catalytic reaction process).

According to one possible method, the urea-water solution is injected directly (optionally by using a carrier gas, for example in the form of an aerosol) into the exhaust gas stream. However, various problems arise in that connection. The relatively large drops of the injection jet or of the spray mist should not, as far as possible, remain adhering to an exhaust pipe wall because they can form chemically and mechanically resistant crystals there which have a corrosive effect on the customary material of the pipe. Secondly, however, a uniform distribution in the exhaust gas stream is also intended to be achieved. That sometimes results in a very narrow control window for the injection of the urea-water solution. In particular taking into consideration the highly dynamic flow conditions and changing temperature conditions of the exhaust gas of a modern internal combustion engine, such a control window cannot always be reliably set with a technically and economically justifiable outlay. Therefore, various mixing devices have been developed in the prior art.

For example, German Patent Application DE 10 2007 052 262 A1 presents a device for mixing and/or evaporating a reducing agent. In that case, a mixer or evaporator is disposed above the entire exhaust duct cross section in which flow conducting elements are located on orthogonal lattice webs.

In that case, the reducing agent is fed in the flow direction of the exhaust gas and some of the reducing agent is placed onto the conducting surfaces of the flow conducting elements. That avoids partial jets spraying through and results in a uniform distribution of the urea-water solution without forming wall films on the inner wall of the exhaust duct. At the same time, the nitrogen oxides are virtually completely converted by the evaporating reaction agent. A disadvantage of such configurations is that impact surfaces which are transverse to the exhaust gas flow and therefore cause a considerable pressure loss have to be formed for the reducing agent. Furthermore, there is forced deposition of the reducing agent, and therefore there is the risk of chemically highly stable wall films, agglomerates, etc. forming on the mixing device. The undesirable, chemically highly stable crystals, which can virtually no longer be eliminated under the conditions in the exhaust system, are formed in particular if the mixing device is too cold or too hot.

In a further known strategy for avoiding the above-described problem, the mixing is achieved by the nozzle geometry or the nozzle configuration. It is known from U.S. Patent Application Publication No. 2011/0067385 A1 to orient the nozzle opening substantially counter to the flow direction of the exhaust gas. The intention thereby is to directly produce turbulence which assists the thorough mixing of an exhaust gas and reducing agent. Furthermore, for many operating states, it can be ensured that the droplets of reducing agent are entrained by the exhaust gas flow before being deposited on the inner wall of the duct. A disadvantage of such a configuration is that it is necessary to prevent deposits from forming by using exhaust gas particles and/or urea reactants at the nozzle opening, which cause the nozzle to become clogged. Furthermore, despite the advantageous configuration, highly dynamic control of the injection times and/or the injection pressure is nevertheless frequently necessary.

Furthermore, the mixing of reducing agent and exhaust gas can be improved by swirl generators or turbulence generators upstream or downstream of the injection nozzle. In that version, the turbulence generators are frequently formed by flow conducting plates oriented transversely with respect to the flow direction. That significantly increases the backpressure for the exhaust gas. Such concepts are disclosed, for example, in International Publication No. WO 2008/061593 A1 or U.S. Patent Application Publication No. 2007/0101703 A1.

SUMMARY OF THE INVENTION

It is accordingly an object of the invention to provide a mixer configuration for reducing agent preparation and a motor vehicle having a mixer configuration, which overcome the hereinafore-mentioned disadvantages and at least partially overcome the highlighted disadvantages of the heretofore-known configurations and vehicles of this general type. In particular, a mixer configuration is intended to be provided, with which the exhaust gas and an additive are adequately mixed with each other and, in the event of the liquid addition of a urea-water solution, deposits of urea reactants on the mixer configuration or on the inside of the exhaust pipe are prevented at the same time. Furthermore, the backpressure as a consequence of a high flow resistance of a mixer configuration, as known from the prior art, is intended to be avoided. It is anticipated at this juncture that the proposed mixer configuration will also be suitable, however, for other additives (such as, for example, water, fuel, gases, etc.) and therefore is not intended to be limited to the use with a urea solution.

With the foregoing and other objects in view there is provided, in accordance with the invention, a mixer configuration for mixing an additive with an exhaust gas stream, wherein the mixer configuration comprises at least one overflow surface which is disposed in a mixing section of an exhaust pipe. The exhaust pipe has a cross section and a main flow direction of the exhaust gas stream. The at least one overflow surface is disposed centrally in the mixing section and is oriented along the main flow direction of the exhaust gas stream. A multiplicity of closed depressions are provided in the overflow surface.

The mixer configuration for mixing an additive with an exhaust gas stream is configured in order to distribute an additive, such as, for example, one of the above-described reducing agents, as homogeneously as possible in an exhaust gas stream. The exhaust pipe forms part of an exhaust system which is connected to a (mobile) internal combustion engine. A mixing section in which the additive is mixed with the exhaust gas stream and turbulence is generated for mixing an additive with an exhaust gas stream is formed in the exhaust pipe. The mixing section is, in particular, disposed upstream of an SCR catalytic converter or a hydrolysis catalytic converter. The cross section of the exhaust pipe is that area of the exhaust pipe through which the flow passes perpendicularly to the main flow direction in the region of the mixing section. The main flow direction of the exhaust gas stream generally refers to the flow direction of the exhaust gas stream, as considered over a relatively large period of time, namely the direction from the internal combustion engine to the outlet of the exhaust pipe. The at least one overflow surface is distinguished especially in that the exhaust gas does not penetrate it, but substantially flows there along and/or is guided there along. A plurality of overflow surfaces can be disposed in the mixing section, with the overflow surfaces preferably being oriented parallel to one another and/or parallel to the main flow direction. The number of overflow surfaces should advantageously be kept low. Preferably, the number of overflow surfaces is fewer than 5 and, particularly preferably, the number is at most 3, 2 or 1. The at least one overflow surface is disposed centrally in the mixing section. "Centrally" in this case should be understood, in particular, as meaning that the (plurality of) overflow surface(s) is (are) disposed centrally in the mass flow of the exhaust gas and/or in the exhaust pipe, and therefore the mass flow is influenced as uniformly as possible by the overflow surface.

A multiplicity of closed depressions are formed in the at least one overflow surface. The depressions are therefore, in particular, open only toward the exhaust gas side. The depressions preferably only constitute a locally limited deformation of the overflow surface. In no way do the depressions form openings, pores and/or ducts through which exhaust gas can flow, in particular the depressions do not pass through the overflow surface. The depressions can describe a circular segment or a segment of an ellipse in the form of dents in the flow direction or can even form a spherical segment or a segment of an ellipsoid. However, they can also be in the form of a cylinder with a substantially round lateral surface, i.e. likewise with an elliptical area or area curved in a free form. However, any other geometry may also be selected for the depressions. The depressions are distinguished, in particular, in that they are formed from an open surface in the overflow surface, closed side walls and a closed base surface. The side surfaces, the base surface and the remaining overflow surface in this case are formed flush with one another in such a way that it is not possible for the exhaust gas stream to flow therethrough (closed). The individual sections of the depression can merge in this case in a flowing manner into one another, as, for example, in the case of a spherical segment.

The number of the depressions is selected, in particular, in such a manner that the depressions are still spaced apart with respect to one another (in particular in the main flow direction). If the depressions are at different distances from one another, it is preferred for the distance from the adjacent depression to be greatest in the main flow direction. In particular, however, it is intended for at least 50%, in particular at least 80%, of the overflow surface to be formed by depressions.

The advantage arising from the mixer configuration described above is that the exhaust gas stream overflowing the overflow surface behaves in the region of at least a plurality of depressions as follows:

The approaching exhaust gas or exhaust gas entering the mixing section (with the additive) has a pronounced flow profile which can be laminar and/or turbulent. The flow profile is especially distinguished in that pressure differences within the flow profile are low, in particular negligibly low. When the flow profile reaches a depression, the pressure drops at least locally because of the expansion in cross section. A flow profile is formed from filaments of flow. In the event of a laminar flow, such a filament of flow constitutes the path of an individual exhaust gas molecule. In the event of a turbulent flow, the filament of flow constitutes exhaust gas molecule paths which run along on one another and are statistically taken as the mean. Upon entry into the widened portion of the cross section, the filaments of flow at a small distance from the overflow surface follow the profile of the depression. Due to the inertia, a region to which the flow is not admitted remains in the entry region of the depression. The region to which the flow is not admitted forms a negative pressure in comparison to the overhanging flow. Such a negative pressure region in turn attracts some of the filaments of flow, and therefore, the filament or the filaments of flow are deflected counter to the flow direction of the arriving flow profile. The filaments of flow, which continue to flow in the main flow direction and pass to the end of the closed depression, are conducted back into the main flow at an angle deviating from the flow profile. Therefore, in the starting region of the depression and/or in the end region of the depression, filaments of flow are deflected in such a manner that they strike against the remaining filaments of flow of the flow profile with a deviating angle (for example 30° to 150°). This generates a pulse transversely with respect to the main flow direction. When a laminar flow is present, the flow, at the latest after flowing over a plurality of depressions, can thus also change into a turbulent flow as a consequence of the pulse. In the case of a laminar flow, as explained at the beginning, the exhaust gas molecules are substantially only diffusively exchanged between the different filaments of flow because of the parallel flow of the exhaust gas molecules. Such a flow is unsuitable for the thorough mixing of the exhaust gas molecules and the additive molecules or additive droplets. It is therefore initially already advantageous for a turbulent flow to be (at least partially reliably) present after a minimum section of the overflow surface.

Furthermore, however, the transverse pulse in the turbulent flow is increased in series after crossing each depression. This means that molecules (increasingly) describe a transverse movement with respect to the main flow direction and are therefore distributed in the exhaust gas stream. This effect is intensified, in particular, by the fact that vortices and vortex trails, which are highly stable in comparison to other influences of the non-deflected portion of the flow profile, and preferably flow laminarly, are produced in the starting region and in the end region of a depression. Such a vortex or such a vortex trail therefore causes a spatial continuation of transverse pulse portions in the exhaust gas flow. A particular advantage of the mixer configuration for inducing turbulent flow and vortices and vortex trails resides, however, in that the exhaust gas is deflected in a region of the widened portion of the cross section of the area through which the flow can pass in the mixer configuration. That is to say, first of all, that a negative pressure is generated and only as a consequence of the negative pressure is the pressure raised again to the previous level. Local increases in pressure are therefore generated solely by the transversely flowing filaments of flow or molecules of the exhaust gas stream.

In contrast to the previously known turbulence generators which are formed with a conducting surface located transversely with respect to the main flow direction, the induction of vortices and transversely flowing filaments of flow do not generate a significant increase in pressure as a consequence of a narrowing of the cross section. Even by using the overflow surface which is oriented along the main flow direction of the exhaust gas stream, only a small increase in pressure is achieved. This increase in pressure is based on the fact that the overflow surface has a structural height which narrows or changes the cross section of the exhaust pipe. However, this effect can be reduced by the fact that the cross section of the exhaust pipe is correspondingly widened in the region of the overflow surface. As a result, the flow cross section can be kept constant or even widened in comparison to the exhaust pipe outside the mixing sections. Furthermore, it should be taken into consideration that, as a consequence of the overflow, only small possibilities of generating deposits are provided. Therefore, the exhaust gas stream is extremely thoroughly mixed with the additive without an excess counterpressure being generated in the exhaust gas.

In accordance with another advantageous feature of the mixer configuration of the invention, the at least one overflow surface is formed by a single-piece plate. Two overflow surfaces are particularly preferably formed by one single-piece plate. That is to say, the single-piece plate has, on both sides, a multiplicity of closed depressions along which the exhaust gas stream flows. In a very simple version, the plate is formed parallel to and/or concentrically with respect to the wall of the exhaust pipe in the mixing section. Preferably, however, the plate is formed parallel to the main mass flow or the main flow direction of the exhaust gas flow. The single-piece plate is substantially flat in the main flow direction. That is to say, the angle which a directly arriving filament of flow has to describe in order to flow over the plate is very obtuse, preferably above 175°. In order to avoid local increases in pressure, the plate in this case can also form an overflow surface which forms a profile optimum for the flow. Furthermore, the plate can be of drop-shaped configuration and/or constructed in the manner of a wing, with the orientation corresponding to a control rudder or a neutral aircraft or profile. If the mixer configuration is formed by a plurality of overflow surfaces, the plurality of single-piece plates are advantageously disposed in such a manner that substantially no narrowing of the flow cross section is caused in the mixing section.

In accordance with a further advantageous feature of the mixer configuration of the invention, the overflow surface is free from elevations. This, in particular, means that no conducting surfaces projecting into the exhaust gas flow are formed in the overflow surface. It follows therefrom, in particular, that the overflow surface at no point generates first of all an increase in pressure and then a drop in pressure. However, it does not mean that the overflow surface inevitably has to form a rectilinear plane. On the contrary, it can have, for example, a (convex) curvature which allows the arriving exhaust gas stream to follow the profile of the overflow surface in an orderly manner without flow separation. In other words, elevations which penetrate into the cross section of the flow in such a manner that they generate local vortices are not provided in the overflow surface.

In accordance with an added advantageous feature of the mixer configuration of the invention, the plate has a thickness which corresponds at maximum to 1.5 times the maximum depth of the depressions. In order to keep the flow resistance of the plate as small as possible, but nevertheless to achieve sufficient stability of the plate, which is weakened by the depressions, the plate should be at maximum 50% thicker than the depressions. Particularly preferably, the maximum depth of the depressions is 2 mm [millimeters] to 8 mm. The smaller the maximum depth of the depressions, the more gentle is the introduction of turbulence and swirling into the exhaust gas stream. The (largest) diagonal of the opening of the depression or the diameter of the depression in this case is preferably 10 mm to 20 mm. The material of the plate is intended to be selected in such a manner that it permanently withstands the mechanical loadings and the high temperature fluctuations of the highly dynamic exhaust gas flow. Due to the small counter pressure which is induced by the plate, the material thickness, i.e. the thickness of the plate, can be selected to be significantly thinner than is necessary for previously known flow conducting surfaces of mixing devices. Also, the material of the plates does not have to be selected so as to be chemically resistant to urea or urea reactants because deposits are prevented from forming on the mixer configuration to such an extent that it results in damage to the plate.

In accordance with an additional advantageous feature of the mixer configuration of the invention, the sum of the thicknesses of all of the plates takes up at maximum 5% [percent] of the cross section of the exhaust pipe. In contrast to previously known flow conducting surfaces which, because of the transverse orientation thereof with respect to the flow direction of the exhaust gas flow, take up a large portion of the area of the cross section of the exhaust pipe, it is possible, with the mixer configuration described, only to take up a small portion of the cross section of the exhaust pipe. In particular, the flow cross section in the exhaust pipe can remain constant with respect to the region of the mixing section. This can be achieved by the cross section of the exhaust pipe being widened in the region of the mixing section by the sum of the thicknesses of all of the plates, or by somewhat more, so that the inertia of the flow profile is taken into account. In particular, the specified limit value for the mixer configuration is valid at each cross section within the mixing section, i.e., in particular, over the entire length of the overflow surface(s).

In accordance with yet another advantageous feature of the mixer configuration of the invention, the depressions in each case form an at least partially sharp edge with the overflow surface. This means that, particularly at the entry region of the depressions, an edge is formed with respect to the overflow surface, which edge is not hydraulically rounded and therefore the filaments of flow previously bearing there against cannot follow the abrupt change in the profile of the overflow surface. The deflection of the flow is thereby particularly efficient because the negative pressure region which deflects the filaments of flow is large and therefore highly influential. The sharpness of the edge should preferably be coordinated with the extent of the opening of the depression and the density of the fluid, thus preventing the flow from being able to flow over a depression without effect, in the flow states during which the additive is added, and therefore preventing the depression from being useless.

With the objects of the invention in view, there is concomitantly provided a motor vehicle, comprising an internal combustion engine and an exhaust system connected thereto. The exhaust system includes a mixer configuration according to the invention. Such a motor vehicle has the advantage that the internal combustion engine has to overcome only a greatly reduced counter pressure and therefore more power of the internal combustion engine is usable for the other functions of the motor vehicle, in particular for driving. Therefore, with the same power of the internal combustion engine in the motor vehicle, a greater efficiency is achieved and, with the same driving power being requested, a lower energy consumption and therefore also a lower emission of greenhouse gases are achieved.

Particularly preferably, during operation of the exhaust system, the depressions in the overflow surface generate a flow resistance which amounts to a portion of less than 5%, preferably less than 1%, of the flow resistance of the mixer configuration. If a mixer configuration without depressions or with filled depressions were therefore installed in a motor vehicle, as compared with the described mixer configuration installed in an identical motor vehicle, the result would be that the coefficient of flow resistance generated would be merely 5%, preferably less than 1%, as compared to the overflow surface without depressions. Whereas, however, a sealed overflow surface brings about virtually no thorough mixing of the exhaust gas stream with the additive, highly efficient mixing of the exhaust gas stream with the additive is achieved with the described mixer configuration.

In order to test this specification, a corresponding vehicle can be prepared with an associated internal combustion engine and exhaust gas system, wherein the central overflow surfaces are used without active depressions. A classic driving cycle (for example FTP or the like) can then be carried out, and the average pressure drop/flow resistance of the overflow surface determined. The test is then repeated, but with the closed depressions being active or being provided. If the above-mentioned limit value for the increase is not exceeded, a particularly good embodiment version of the mixer configuration according to the invention for the specific use has been found. If the limit value should nevertheless be exceeded, in particular the number of depressions should be (at least partially) reduced, the distance of the depressions from one another should be increased, the edge sharpness of the depressions increased and/or the size of the depressions reduced.

All in all, a highly effective mixer configuration which very efficiently mixes an additive with the exhaust gas stream and at the same time only generates a small flow resistance is proposed.

Other features which are considered as characteristic for the invention are set forth in the appended claims, noting that the features recited in the claims can be combined with one another in any technically expedient manner, resulting in further embodiments of the invention and that the features and functions which are explained in the description and/or are illustrated in the figures can be used for further characterization of the invention, thus resulting in further preferred embodiments of the invention.

Although the invention is illustrated and described herein as embodied in a mixer configuration for reducing agent preparation and a motor vehicle having a mixer configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
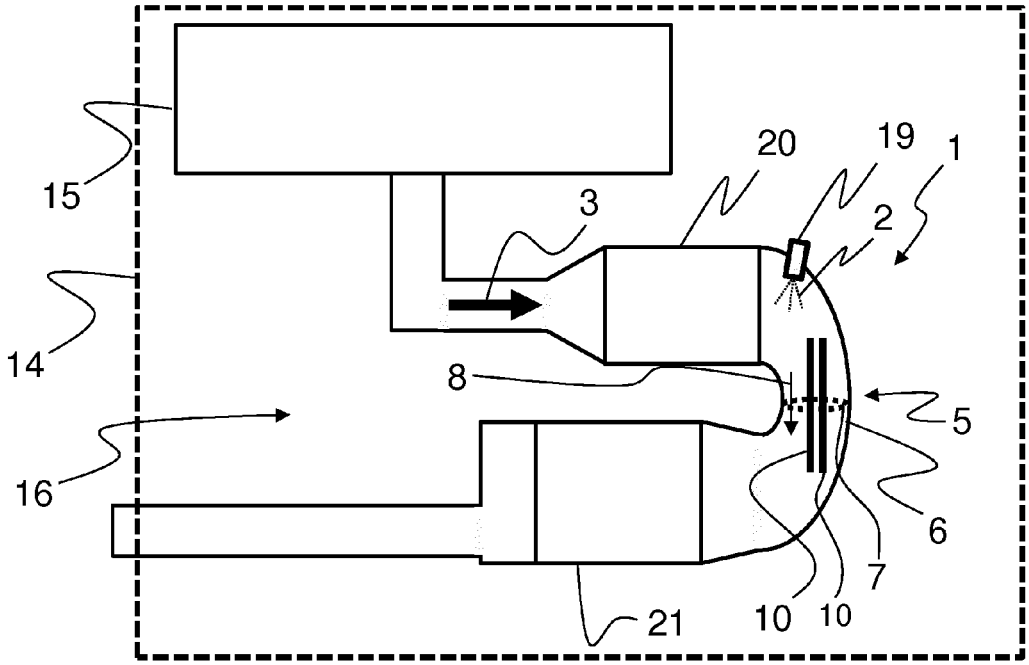
FIG. 1 is a diagrammatic view of a motor vehicle with an internal combustion engine and an exhaust system.

Referring now in detail to the diagrammatic figures of the drawing for explaining the invention and the technical field in more detail by showing particularly preferred structural variants to which the invention is not restricted and in which identical components are denoted by the same reference numbers, and first, particularly, to FIG. 1 thereof, there is seen a motor vehicle 14 with an internal combustion engine 15 and an exhaust system 16. The internal combustion engine 15 is preferably a diesel engine or a spark ignition engine operated with a lean mix (with excess air). In this example, an exhaust gas stream 3 in the exhaust system 16 first of all flows over a first exhaust gas cleaning element 20 and, after flowing through a mixing section 5, over a second exhaust gas cleaning element 21. In this example, an injection nozzle 19 which adds an additive 2 to the exhaust gas stream 3 is directly connected at a connection to the first exhaust gas cleaning element 20. A plate 10 which is oriented along a main flow direction 8 of the exhaust gas stream 3 is disposed in an adjoining mixer configuration 1. This is a preferred configuration which is established in the prior art, but does not justify any restriction of the inventive concept. An exhaust pipe 6 has a cross section 7 in the region or vicinity of the mixing section 5. It can readily be seen in this example that the plate 10 of the mixer configuration 1 is configured in such a manner that the main flow direction 8 of the exhaust gas stream 3 is not deflected. The first exhaust gas cleaning element 20 is particularly preferably a particle filter and/or an oxidizing catalytic converter. The added additive 2 is particularly preferably a urea-water solution. Furthermore, the second exhaust gas cleaning element 21 includes a selective reduction catalytic converter (SCR catalytic converter). In principle, however, it is also possible for the first exhaust gas cleaning element 20 to be disposed in or after the mixing section 5.

Figure 2:
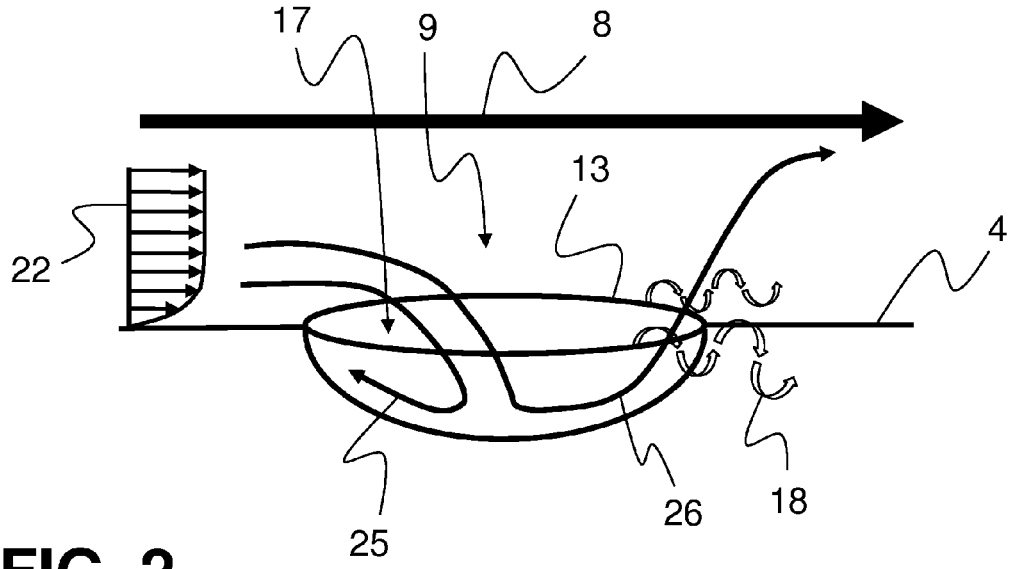
FIG. 2 is a perspective view showing an overflow surface with a depression.

FIG. 2 shows details of an overflow surface 4 with a depression 9. The arriving exhaust gas forms a flow profile 22 at the overflow surface 4. The flow profile 22 is oriented along the main flow direction 8. The depression 9 is shell-shaped, dent-shaped, etc. and forms a sharp edge 13 with the remaining overflow surface 4. Due to the inertia of the filaments of flow, which are illustrated diagrammatically therein with a first filament of flow 25 and a second filament of flow 26, a negative pressure region 17 is produced from the flow profile 22 in the entry region of the depression 9. Accordingly, the first filament of flow or fluid element 25 is deflected in such a manner that it is oriented counter to the main flow direction 8. At the end side of the depression 9, the second filament of flow or fluid element 26 emerges again from the depression 9 with a transverse portion with respect to the main flow direction 8. Over the course of the second filament of flow 26, the latter always obtains a flow portion which is oriented along the main flow direction 8. Upon exiting from the depression 9, the transverse portion of the filament of flow 26 with respect to the remaining flow profile 22 induces a swirling 18 or a vortex trail which constitutes a stable flow state that brings about thorough mixing of the exhaust gas with the non-illustrated additive 2 because of the high pulse influence on the flow profile 22.

Figure 3:
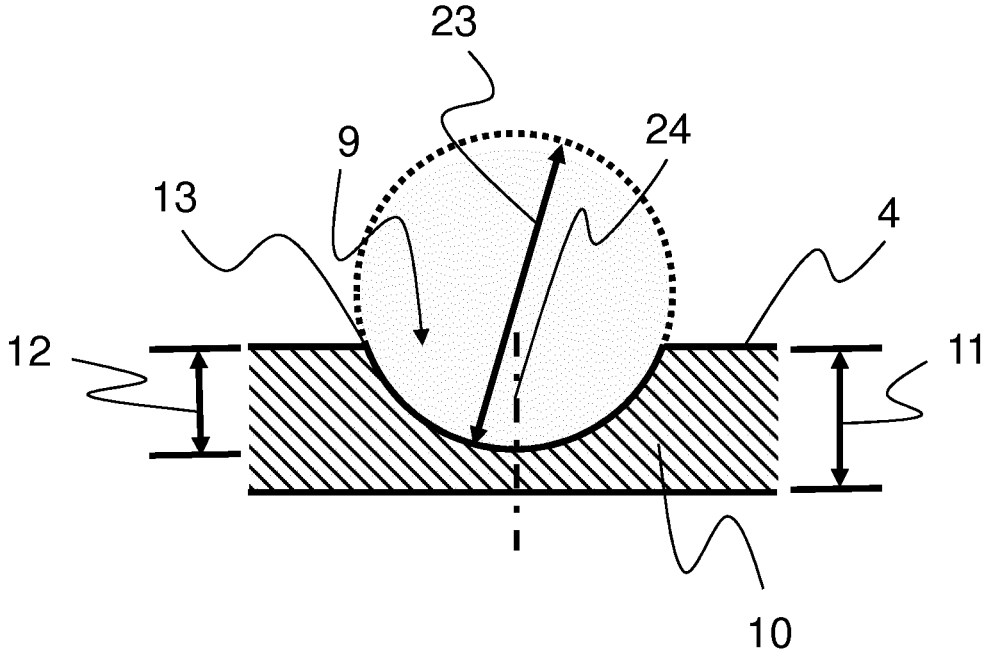
FIG. 3 is a sectional view of a spherical segment-shaped depression in a plate.

FIG. 3 shows a sectional illustration of a further possible embodiment of a depression 9 in a plate 10. In this case, the depression 9 forms a spherical segment with a diameter 23 and an axis of rotation 24. The spherical segment forms a sharp edge 13 with the overflow surface 4. The depression 9 has a maximum depth 12 which, in this example, reaches approximately two thirds of the thickness 11 of the plate 10.

Figure 4:
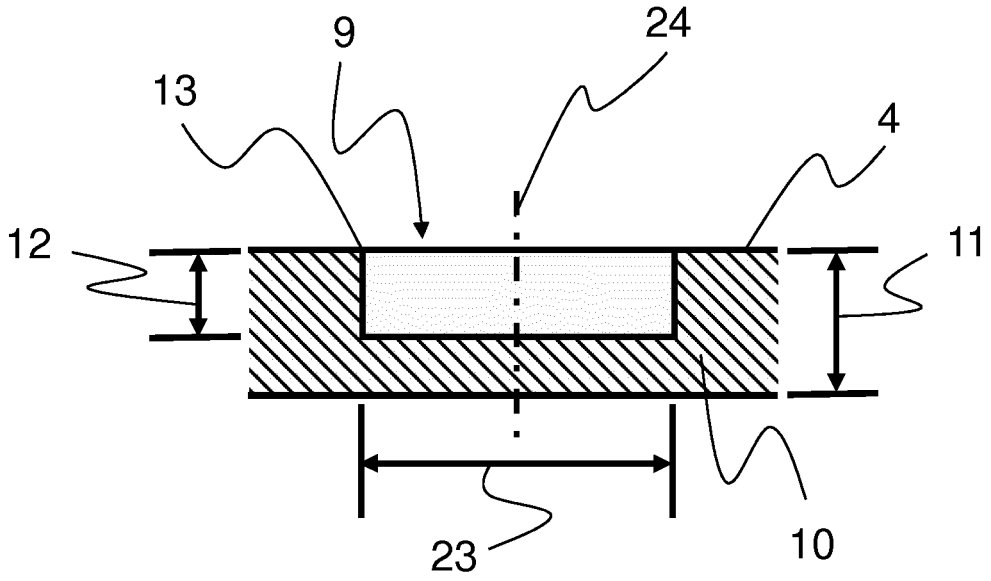
FIG. 4 is a sectional view of a cylindrical depression in a plate.

FIG. 4 also shows a version of a depression 9 in a plate 10. The depression 9 in this case is formed cylindrically and has a diameter 23 and an axis of rotation 24. This depression 9 also forms a sharp edge 13 with the overflow surface 4. In this example, the maximum depth forms the overall area of the depression 9 and is approximately 60% of the thickness 11 of the plate 10. However, any other parameters can also be selected for a depression 9 in order to realize the inventive concept, in which the flow effect as shown, for example, in FIG. 2 can be achieved and the technical outlay is kept as small as possible.

Figure 5:
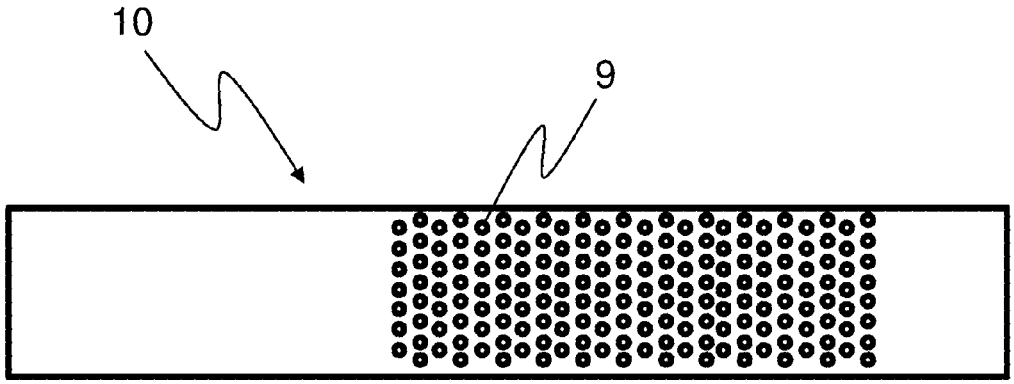
FIG. 5 is a plan view showing a configuration of a multiplicity of depressions on a plate.

FIG. 5 shows a top view of a plate 10, in which a multiplicity of depressions 9 are disposed so as to be spaced apart from one another one behind another. The depressions do not have to be strictly ordered at a fixed distance from one another, as shown in the example in FIG. 5, but rather can be introduced into the plate 10 as desired. However, it is particularly advantageous to select the spacing in a uniform manner and in such a way that the effect on the flow, as shown, for example, in FIG. 2, is achieved as efficiently as possible. The plate 10 in this case does not have to be formed in as plain and flat a manner as shown in FIG. 5, but rather other free forms and, in particular, flow profiles with a low coefficient of flow resistance can also be selected. The shape of the plate 10 can also be matched to the cross section 7 (FIG. 1).

The explanations of the figures can also be used independently of the specifically illustrated embodiment version for understanding and for more accurate description of the invention.

The invention therefore at least partially solves the technical problems described in conjunction with the prior art. In particular, a mixer configuration which permits excellent thorough mixing of the exhaust gas stream with an additive, in particular a urea-water solution added in a drop-shaped manner, without generating a high flow resistance in the process, has been proposed.

The invention claimed is:

1. An exhaust system, comprising:

an exhaust pipe having a mixing section, a cross section and a main flow direction of an exhaust gas stream; and a mixer configuration for mixing an additive with the exhaust gas stream, the mixer configuration including:

at least one overflow surface disposed centrally in the mixing section and oriented along the main flow direction of the exhaust gas stream;

said at least one overflow surface having a multiplicity of closed depressions formed therein;

said at least one overflow surface being formed by one or a plurality of plates each having a thickness; and a sum of said thicknesses of said one plate or of said plurality of plates taking up at most 5% of said cross section of said exhaust pipe.

2. An exhaust system, comprising:

an exhaust pipe having a mixing section, a cross section and a main flow direction of an exhaust gas stream; and a mixer configuration for mixing an additive with the exhaust gas stream, the mixer configuration including:

at least one overflow surface disposed centrally in the mixing section and oriented along the main flow direction of the exhaust gas stream;

said at least one overflow surface having a multiplicity of closed depressions formed therein;

said at least one overflow surface being formed by one or a plurality of plates each being parallel to the main flow direction of the exhaust gas stream and each having a thickness; and a sum of said thicknesses of said one plate or of said plurality of plates taking up at most 5% of said cross section of said exhaust pipe.

3. The exhaust system according to claim 2, wherein said one plate is a single-piece plate.

4. The exhaust system according to claim 3, wherein said at least one overflow surface is free from elevations.

5. The exhaust system according to claim 3, wherein said depressions have a maximum depth, and said plate has a thickness corresponding to at most 1.5 times said maximum depth of said depressions.

6. The exhaust system according to claim 2, wherein said at least one overflow surface is free from elevations.

7. The exhaust system according to claim 6, wherein said depressions have a maximum depth, and said plate has a thickness corresponding to at most 1.5 times said maximum depth of said depressions.

8. The exhaust system according to claim 2, wherein said depressions each form a respective at least partially sharp edge with said at least one overflow surface.

9. The exhaust system according to claim 2, wherein said multiplicity of closed depressions form a negative pressure changing a laminar flow into a turbulent flow.

10. The exhaust system according to claim 2, wherein:

the exhaust gas stream has a higher pressure level upstream of said mixing section and a lower pressure level in said mixing section;

said multiplicity of closed depressions develop filaments of flow or molecules flowing transversely to the exhaust gas stream which generate local increases in pressure and form a negative pressure raising the lower pressure level back to said higher pressure level.

11. A motor vehicle, comprising:

an internal combustion engine; and an exhaust system connected to said internal combustion engine;

said exhaust system including an exhaust pipe having a mixing section, a cross section, a main flow direction of an exhaust gas stream, and a mixer configuration configured to mix an additive with said exhaust gas stream;

said mixer configuration having at least one overflow surface disposed centrally in said mixing section and oriented along said main flow direction of said exhaust gas stream;

said at least one overflow surface being formed by one or a plurality of plates each being parallel to the main flow direction of the exhaust gas stream and each having a thickness, a sum of said thicknesses of said one plate or of said plurality of plates taking up at most 5% of said cross section of said exhaust pipe; and said at least one overflow surface having a multiplicity of closed depressions formed therein.

12. The motor vehicle according to claim 11, wherein said multiplicity of closed depressions form a negative pressure changing a laminar flow into a turbulent flow.

13. The motor vehicle according to claim 11, wherein:

the exhaust gas stream has a higher pressure level upstream of said mixing section and a lower pressure level in said mixing section;

said multiplicity of closed depressions develop filaments of flow or molecules flowing transversely to the exhaust gas stream which generate local increases in pressure and form a negative pressure raising the lower pressure level back to said higher pressure level.

* * * * *